United States Patent [19]

Dvorak

[11] Patent Number: 4,906,180

[45] Date of Patent: Mar. 6, 1990

[54] TILE RETAINER MEANS

[75] Inventor: John A. Dvorak, Romeo, Mich.

[73] Assignee: Solaronics, Rochester, Mich.

[21] Appl. No.: 371,328

[22] Filed: Jun. 26, 1989

[51] Int. Cl.[4] ..... F23D 14/12

[52] U.S. Cl. ..... 431/328; 126/92 AC

[58] Field of Search ..... 431/328, 170, 7; 126/92 C, 92 R, 92 AC

[56] References Cited

U.S. PATENT DOCUMENTS

| | | | |
|---|---|---|---|
| 3,024,836 | 3/1962 | Bello | 431/328 X |
| 3,167,110 | 1/1965 | Szell | 431/328 |
| 4,737,102 | 4/1988 | Jinno et al. | 431/328 |

*Primary Examiner*—Randall L. Green

*Attorney, Agent, or Firm*—Lynn E. Cargill

[57] ABSTRACT

A gas fired infrared burner ceramic tile retainer for securing ceramic burner tiles within a plenum including a one-piece cut-and-form stamped tile retainer made of continuous sheet metal includes a top portion which is substantially horizontal for engaging the burner tile edge and a transverse portion which is substantially perpendicular to the top portion which includes a plurality of tabs extending downwardly from the transverse portions. These tabs are placed at intervals around the bottom of the tile retainer and are adapted to be bent under the plenum which contains the burner tile. The plenum has a tile receiving lip around its upper outer perimeter, and the tabs are bent underneath this lip to secure the burner tile by sandwiching the outer edges of the burner tile between the tile retainer and the plenum tile receiving lip. The disclosed tile retainer furthermore helps to maintain a substantially gas tight seal between the ceramic tile and the plenum.

9 Claims, 1 Drawing Sheet

TILE RETAINER MEANS

TECHNICAL FIELD

This invention relates generally to gas fired infrared burners, and more particularly to a ceramic tile retainer means for securing a tile to a burner plenum.

BACKGROUND OF THE INVENTION

Infrared burners are used for efficiently heating various solid objects and fluids including air, water and oil. During their manufacture, assembly of the various components poses certain problems. A radiant burner typically consists of a ceramic tile or a plurality of ceramic tiles which are supported within a gas mixing plenum. The ceramic tile or tiles may be secured within the plenum by various means such as cementing or employing spokes between the ceramic tiles. These techniques rigidly secure the tiles and do not allow the flexibility which is needed to withstand thermal and physical shock and to effectively seal the juncture of the ceramic tile and the plenum. To alleviate this problem, a flexible tile retainer means may be used to secure the ceramic tile within the plenum. Typically, a cloth-like refractory material gasket is cushioned between the tile retainer means and the ceramic tile edges to help absorb possible thermal and physical shock to the burner assembly, thereby reducing damage. A usual tile retainer has a ceramic tile edge engaging portion and a depending transverse portion where the retainer is attached to the plenum by a mechanical fastening means. In the past, these mechanical fastening means have included nut and bolt attachments, rivets, or screw attachments.

In the past, conventional infrared burners have been manufactured by including mechanical fastening means between the tile retainer and the plenum which contains the burner tile. As discussed below, there have been many attempts to design new infrared burner assemblies for greater efficiency and ease of manufacture. In the prior art, mechanisms such as nuts and bolts, rivets, or screws have been utilized to secure the tile retainer to the outer plenum lip. During assembly, it has been found that manufacturers using a nut and bolt system require several minutes per infrared burner to assemble. For those manufacturers utilizing rivets or screws attaching to complementary mated threads, assembly takes more than about one minute per burner.

During the manufacture of infrared burners, the burner tile component is merely dropped into the plenum and then the tile retainer acts to secure the burner tile within the plenum. Until now, the manufacture of these burner assemblies has included the use of many workers to hand tighten the nuts and bolts or screws which secure the tile retainer to the plenum. The following patents disclose various prior art means and methods for securing the tile retainer to the plenum.

U.S. Pat. No. 4,035,132 issued on Jul. 12, 1977 to Smith discloses a radiant heater having a supported porous refractory panel through which combustion mixture passes and burns. The patent further discloses a gas-fired radiant heater which reduces the likelihood of backflashing by including a tubular frame for supporting a porous refractory panel. Upper frame members are included which have upper flanges overlying the outer face of the porous refractory panel. The flanges of the frame members are secured to a lower frame member by a screw attachment means.

U.S. Pat. No. 3,556,707 issued on Jun. 5, 1969 to Hine discloses a gas-fired radiant heater assembly having a plurality of porous ceramic tiles forming a radiant gas burning surface in which the tiles are supported on two parallel longitudinally extending metal shelves. Each support shelf is secured to a respective longer side of a rectangular frame member that is removably attached to the opening of the heater body, specifically depicted in the drawings as a threaded nut and bolt.

U.S. Pat. No. 3,824,064 issued on Jul. 16, 1974 to Bratko discloses an infrared process burner comprised of individual sections rigidly fastened together to provide an elongated unit having a common continuous burner face. A tile retaining rim is disclosed for securing the sections and includes a face engaging portion acting as a lip, and an upright section made from angle iron. Extending upwardly from the upright section and at intervals therearound are studs having threaded ends thereon, adapted to be received in suitable ears fastened to sides of a burner body. The application of nuts is contemplated to keep the tile retaining rim in place and thereby retains the burner face in position over the openings of the burner body.

Accordingly, it would be advantageous to provide a tile retainer design that is adapted for automatically securing and sealing burner tiles within the plenum of a gas fired infrared burner. Such a tile retainer design would help to lend automated assembly to the production of infrared burner assemblies.

It would be further advantageous to provide a tile retainer design that would help to maintain a spring-like pressure to retain a substantially gas tight seal between the ceramic tile and the plenum over the service life of the gas fired infrared burner. Conventional mechanical fastening means have included nuts and bolts, rivets, and screws which are substantially fixed in place and do not allow for movement with the expansion and contraction of the burner assembly during service.

It is therefore an object of the present invention to provide an infrared burner tile retainer for securing and sealing a burner tile within a plenum by a plurality of tabs extending downwardly from the tile retainer so that the tabs may be bent underneath the plenum lip by automated equipment to form an entire manufactured unit without having to use mechanical fastening means such as nuts and bolts or screws which are time consuming and difficult to automate.

It is another object of the present invention to provide a one-piece cut-and-form stamped tile retainer that may be made of stainless steel, aluminized stainless steel, or any other sheet material which exhibits heat resistivity and low creep characteristics.

SUMMARY OF THE INVENTION

In accordance with the present invention there is provided an improved tile retainer for retaining burner tiles within a plenum of an infrared burner assembly. The tile retainer of the present invention includes protruding tabs as the means for attaching the tile retainer to the infrared burner, thereby eliminating the need for time consuming, labor intensive mechanical fastening means such as nuts and bolts, rivets, or screws. The tile retainer may be a one-piece retainer that sandwiches, secures and seals at least one burner tile within a burner plenum. The tile retainer includes a substantially horizontal engaging top portion that overlies the upper outside perimeter of the burner tile edge and furthermore includes downwardly extending depending transverse portions which are substantially perpendicular to the tile edge engaging top portion. Integral wit the downwardly extending transverse portions are tabs that may be bent under the plenum lip for securing and sealing the burner tile within the plenum. The tabs replace conventional mechanical fasteners, thereby lending the attachment of the tile retainer to the plenum to automated assembly during the manufacturing process.

In the preferred embodiment, an infrared burner tile retainer for securing at least one burner tile within a plenum to form an infrared burner assembly is disclosed. The burner tiles have outer edges around their upper outside perimeters and they rest on a burner tile receiving lip around the upper outside perimeter of the plenum. The plenum is generally of a substantially rectangular shape, and the tile retainer follows that shape. The preferred tile retainer is a one-piece cut-and-form stamped tile retainer made of continuous sheet metal which includes a substantially horizontally extending four-section tile edge engaging portion having four downwardly extending depending transverse portions which are substantially perpendicular to the edge engaging top portion. The continuous sheet metal is notched and slotted to form thermal stress relief sections such that when the burners are turned on and off, the tile retainer material can expand and contract without deforming the tile retainer.

The tile retainer is shaped and adapted for placement over the upper outside perimeter of the substantially rectangular plenum, thereby covering and sealing the outer edges of the burner tiles. The design of the tile retainer maintains a flexible, spring-like pressure to provide a substantially gas tight seal between the ceramic tile and the plenum, while allowing for movement due to expansion and contraction.

The means for securing the tile retainer to the outer lip of the plenum is a plurality of tabs extending downwardly from the transverse portions of the tile retainer at intervals therearound. The tabs are adapted to be bent underneath the plenum tile receiving lip to secure the burner tile within the plenum by sandwiching the outer edges of the burner tile between the tile retainer and the plenum tile receiving lip.

The main advantage of the present invention is that mechanical fastening means, such as nuts and bolts, rivets, or screws, are not needed for assembly. The tab design can be bent by an automated machine, instead of using hand workers which are very labor intensive. The tile retainer may be made of a metal such as stainless steel or aluminized stainless steel, or any other sheet metal having heat resistive and low creep characteristics.

Furthermore, the plurality of tabs are integral with the rest of the tile retainer and are easy to form in a one-piece retainer which is made by cut-and-form stamping from a sheet metal blank. The cut-and-form stamping procedure can cut the tile retainer, form the tabs, cut the thermal slots, and bend the edges to form the downwardly extending transverse portions all in one step. Thereafter, placement of the tile retainer over the burner tile plenum combination is a one-step process. To finalize assembly, a machine may be used to automate the assembly by pressing the tabs into position underneath the plenum lip.

DETAILED DESCRIPTION OF THE INVENTION

Figure 1:
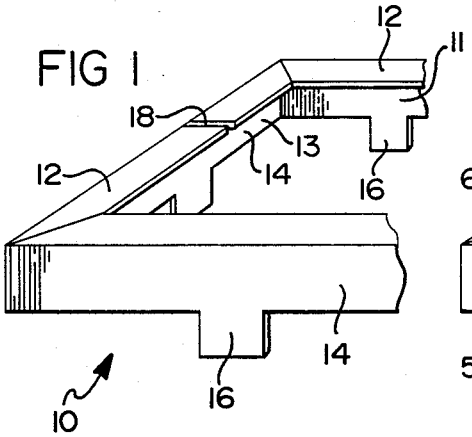
FIG. 1 is a side perspective view of an infrared burner tile retainer.

Turning first to FIG. 1, a one-piece cut- and-form stamped tile retainer is shown and generally denoted by the numeral 10. The tile retainer 10 includes substantially horizontally extending tile edge engaging portions 12 and depending downwardly extending transverse portions 14. Transverse portions 14 are substantially perpendicular to the tile edge engaging portions 12. The shape of the tile retainer 10 is substantially rectangular with two length portions 11 and two width portions 13 and is adapted to fit over a plenum as more clearly shown in FIG. 3.

A plurality of tabs 16 extend downwardly from the transverse portions 14 of the tile retainer 10 and are located at intervals therearound. Preferably, there are two tabs on each of the length portions 11 and width portions 13. Tabs 16 are adapted to be bent inwardly and perpendicularly to the transverse portions 14. When tabs 16 are bent inwardly and perpendicularly to transverse portions 14, the tabs are substantially parallel to the tile edge engaging portions 12. Along the tile edge engaging portions 12, thermal stress relieving slots 18 are located on each of the two length portions 11 and the two width portions 13 as required. Thermal stress relieving slots 18 are cut during the cut-and-form stamping.

Looking again to FIG. 1, tile retainer 35 maintains a spring-like pressure to retain a substantially gas tight seal between the ceramic tile 40 and plenum 32 due to the semi-flexible fastening arrangement. This allows for movement resulting from expansion and contraction of the assembly during the service life of the gas fired infrared burner and helps to prolong the life of the entire unit.

Figure 2:
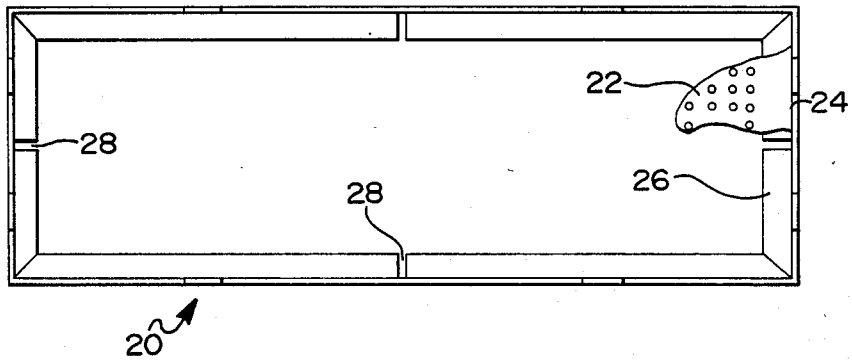
FIG. 2 is a top plan view of the infrared burner tile retainer.

In looking now to FIG. 2, a top plan view of the one-piece cut-and-form stamped tile retainer 20 is shown. The rectangular shape of tile retainer 20 is adapted for securing a rectangular tile 22 to an infrared burner plenum thereunder. Tile edge engaging top portions 26 cover only an outer tile edge 24. The upper surface of tile 22 is the site of the burning gas mixture which radiates heat. Tile edge engaging portions 26 cover the tile outer edge 24, and are thereby exposed to high temperatures from the radiating tile 22. High temperature stressing of the tile edge engaging portions 26 is relieved by thermal stress relieving slots 28. Utilizing thermal stress relieving slots 28 enhances the durability and lifetime of the tile retainer 20.

Figure 3:
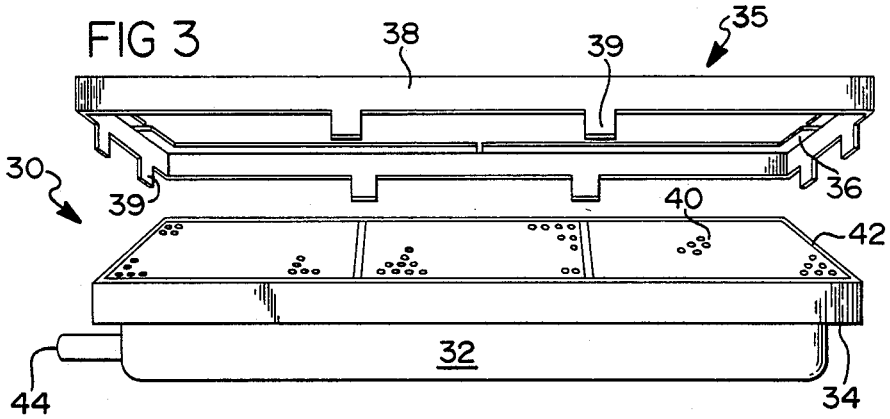
FIG. 3 is an exploded perspective view of an infrared burner including a retainer and a plenum having a tile receiving lip, and shows the relative placement of the tile retainer over and on top of the tile which rests on the plenum lip.

Referring now to FIG. 3, there is shown an exploded perspective view of an infrared burner generally denoted by the numeral 30. Infrared burner 30 includes a tile retainer 35, a plurality of tiles 40 and a plenum 32. At gas injection point 44, a combustible gas is injected into plenum 32 where the combustible gas is mixed with an appropriate amount of air by means of a Venturi arrangement or mechanical premix means. Plenum 32 includes a tile receiving lip 34 for receiving outer edges 42 of tile 40. The upper surface of tile 40 is the site of the burning of the gas mixture which radiates high temperatures. This is the radiating source of the infrared burner 30. Outer tile edges 42 are sandwiched between tile receiving lip 34 and tile edge engaging top portions 36 as more clearly described hereinbelow with reference to FIG. 4. Depending transverse portions 38 extend downwardly from tile edge engaging top portions 36. A plurality of tabs 39 extend downwardly from the depending transverse portions 38. The tabs 39 are adapted to be bent underneath the tile receiving lip 34 when the tile retainer 35 is secured on the plenum 32. Tabs 39 may be bent underneath the tile receiving lip 34 by automated manufacturing equipment.

Figure 4:
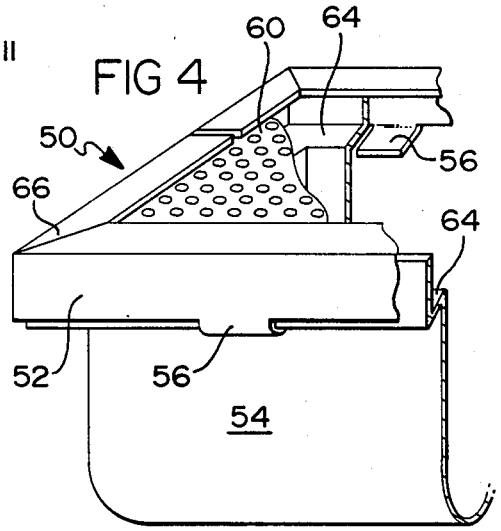
FIG. 4 is a side perspective cut-away view of an assembled infrared burner including a one-piece cut-and-form stamped tile retainer secured to a plenum by tabs integral with the tile retainer.

Finally turning to FIG. 4, a top perspective cut-away view of an assembled infrared burner with the tile in place is generally denoted by the numeral 50. A tile retainer 52 is secured to a plenum 54 by perpendicularly bent tabs 56. Tabs 56 are perpendicularly bent under the tile receiving lip 64. Tile retainer 52 secures the outer edges of tile 60 by sandwiching the outer tile edges between the tile receiving lip 64 and tile edge engaging top portions 66 of tile retainer 52.

While my invention has been described in terms of a specific embodiment, it must be appreciated that other embodiments could readily be adapted by one skilled in the art. Accordingly, the scope of my invention is to be limited only by the following claims.

What is claimed is:

1. A gas fired infrared burner tile retainer for securing at least one ceramic burner tile within a plenum to form an infrared burner assembly, said at least one burner tile having outer edges around its upper outside perimeter, and said plenum being substantially rectangular in shape and having a burner tile receiving lip, said tile retainer comprising:

a one-piece cut-and-form stamped tile retainer made of continuous sheet metal including a substantially horizontally extending four-section tile edge engaging top portion and four downwardly extending depending transverse portions which are substantially perpendicular to the edge engaging top portion, said continuous sheet metal being cut to form two length sections and two width sections such that when the sheet metal is shaped and adapted for placement over the upper outside perimeter of the substantially rectangular plenum, the outer edges of the burner tile will be covered;

said tile retainer including thermal stress relieving slots cut into the tile retainer at intervals therearound; and a plurality of tabs extending downwardly from the transverse portions of said tile retainer at intervals therearound which are adapted to be bent underneath the plenum tile receiving lip to secure the burner tile within the plenum by sandwiching the outer edges of the burner tile between the tile retainer and the plenum tile receiving lip.

2. The tile retainer of claim 1, wherein said tabs are integral with the tile retainer.

3. The tile retainer of claim 1, wherein at least two tabs are placed at even intervals on each of the two length sections and at least two tabs are placed at even intervals on each of the width sections.

4. The tile retainer of claim 1, wherein the tabs are substantially rectangular in shape and are from about one quarter to about two inches in length and about one quarter to about one inch in width.

5. The tile retainer of claim 1, wherein the tabs are substantially rectangular in shape and are about a half an inch in length and about a half an inch in width.

6. The tile retainer of claim 1, wherein said retainer is made of a metal having heat resistive and low creep characteristics.

7. The tile retainer of claim 6, wherein the metal is a stainless steel.

8. The retainer of claim 6, wherein the metal is aluminized stainless steel.

9. A gas fired infrared burner tile retainer for securing at least one ceramic burner tile within a plenum to form an infrared burner assembly, said at least one burner tile having outer edges around its upper outside perimeter, and said plenum being substantially rectangular in shape and having a burner tile receiving lip, said tile retainer comprising:

a one-piece cut-and-form stamped tile retainer made of continuous sheet metal including a substantially horizontally extending four-section tile edge engaging top portion and four downwardly extending depending transverse portions which are substantially perpendicular to the edge engaging top portion, said continuous sheet metal being cut to form two length sections and two width sections such that when the sheet metal is shaped and adapted for placement over the upper outside perimeter of the substantially rectangular plenum, the outer edges of the burner tile will be covered;

said tile retainer including thermal stress relieving slots cut into the tile retainer at intervals therearound;

a plurality of tabs extending downwardly from the transverse portions of said tile retainer at intervals therearound which are adapted to be bent underneath the plenum tile receiving lip to secure the burner tile within the plenum by sandwiching the outer edges of the burner tile between the tile retainer and the plenum tile receiving lip;

said tabs being integral with the tile retainer and being made of a stainless steel metal having heat resistive and low creep characteristics; and said tabs being placed at even intervals on each of the two length sections and two width sections, and said tabs being about one-half inch in length and about one-half inch in width.

* * * * *